US006644476B2

(12) United States Patent
Wu

(10) Patent No.: US 6,644,476 B2
(45) Date of Patent: Nov. 11, 2003

(54) CUSHION PACKAGE STRUCTURE

(75) Inventor: Tsan Sheng Wu, Taipei (TW)

(73) Assignee: Inventec Corporation, Taipei (TW)

( * ) Notice: Subject to any disclaimer, the term of this patent is extended or adjusted under 35 U.S.C. 154(b) by 69 days.

(21) Appl. No.: 10/080,552

(22) Filed: Feb. 25, 2002

(65) Prior Publication Data

US 2003/0159970 A1 Aug. 28, 2003

(51) Int. Cl.[7] ..... B65D 81/02
(52) U.S. Cl. ..... 206/586; 206/587; 206/591
(58) Field of Search ..... 206/523, 586, 206/587, 588, 589, 590, 591, 592, 593

(56) References Cited

U.S. PATENT DOCUMENTS 3,244,347 A * 4/1966 Jenk ..... 206/586
3,356,209 A * 12/1967 Pezely, Jr. ..... 206/586
3,900,156 A * 8/1975 Clark, Jr. ..... 206/586
3,994,433 A * 11/1976 Jenkins et al. ..... 206/586
4,287,265 A * 9/1981 McKnight ..... 428/542
4,724,960 A * 2/1988 Goodrum et al. ..... 206/397
4,840,277 A * 6/1989 Waldner ..... 206/523
5,692,618 A * 12/1997 Beak ..... 206/586
5,755,331 A * 5/1998 Watson ..... 206/586
6,082,543 A * 7/2000 Beliveau ..... 206/523
6,488,153 B1 * 12/2002 Morris ..... 206/523

* cited by examiner

*Primary Examiner*—Shian Luong
(74) *Attorney, Agent, or Firm*—Jacobson Holman PLLC

(57) ABSTRACT

A cushion package structure conforming to environmental protection recycling regulations utilizes corrugated paper and elastic cushion materials (EPE) to replace conventional polylone. The corrugated paper and EPE are latched and coupled together without using hot adhesive. Thus EPE and corrugated paper may be reclaimed and recycled separately to achieve environmental protection purposes.

5 Claims, 5 Drawing Sheets

CUSHION PACKAGE STRUCTURE

FIELD OF THE INVENTION

The invention relates to a cushion package structure, and particularly a structure made of corrugated paper and cushion materials (EPE) that conforms to environmental protection recycling regulations.

BACKGROUND OF THE INVENTION

Corrugated paper boxes (such as ROC Patent publication No. 67039, entitled: "Novel paper box structure") and polylone are package materials that have been widely used for a long time. Polylone is mainly used for cushioning and protecting internal goods from external forces. But due to the fact that Polylone creates great environmental protection problems, it is gradually being replaced by other packaging materials.

In order to reduce the cost of cushion packages, some package materials have been developed that combine corrugated paper and EPE (such as elastic blowing materials).

The conventional structure of corrugated paper and EPE such as the one shown in FIG. 1 generally involves directly bonding corrugated paper 10 to EPE 20 through hot adhesive 30. Then the corrugated paper 10 bonded with the EPE 20 is folded according to preset bend lines to form package boxes in order to provide the function of packaging goods and cushioning impacts. However, the package materials made by the conventional techniques set forth above are difficult to recycle. To reclaim and recycle EPE 20 is not easy. Thus they do not conform to environmental protection recycling regulations.

SUMMARY OF THE INVENTION

The primary object of the invention is to provide a cushion package structure that conforms to environmental protection requirements. The invention provides a design that can couple corrugated paper and EPE in a latched fashion to resolve the recycling problem resulting from adhesive bonding that occurs with the conventional techniques.

The invention does not utilize hot adhesive or other fixed bonding methods to bond the corrugated paper and EPE, but uses a structure similar to tenon and mortise to latch and couple the corrugated paper and EPE together. The structure may be assembled or disassembled readily, and does not create environmental protection recycling problems.

The foregoing, as well as additional objects, features and advantages of the invention will be more readily apparent from the following detailed description, which proceeds with reference to the accompanying drawings. The drawings are only to serve for reference and illustrative purposes, and are not intended to limit the scope of the invention.

DESCRIPTION OF THE PREFERRED EMBODIMENTS

Figure 1:
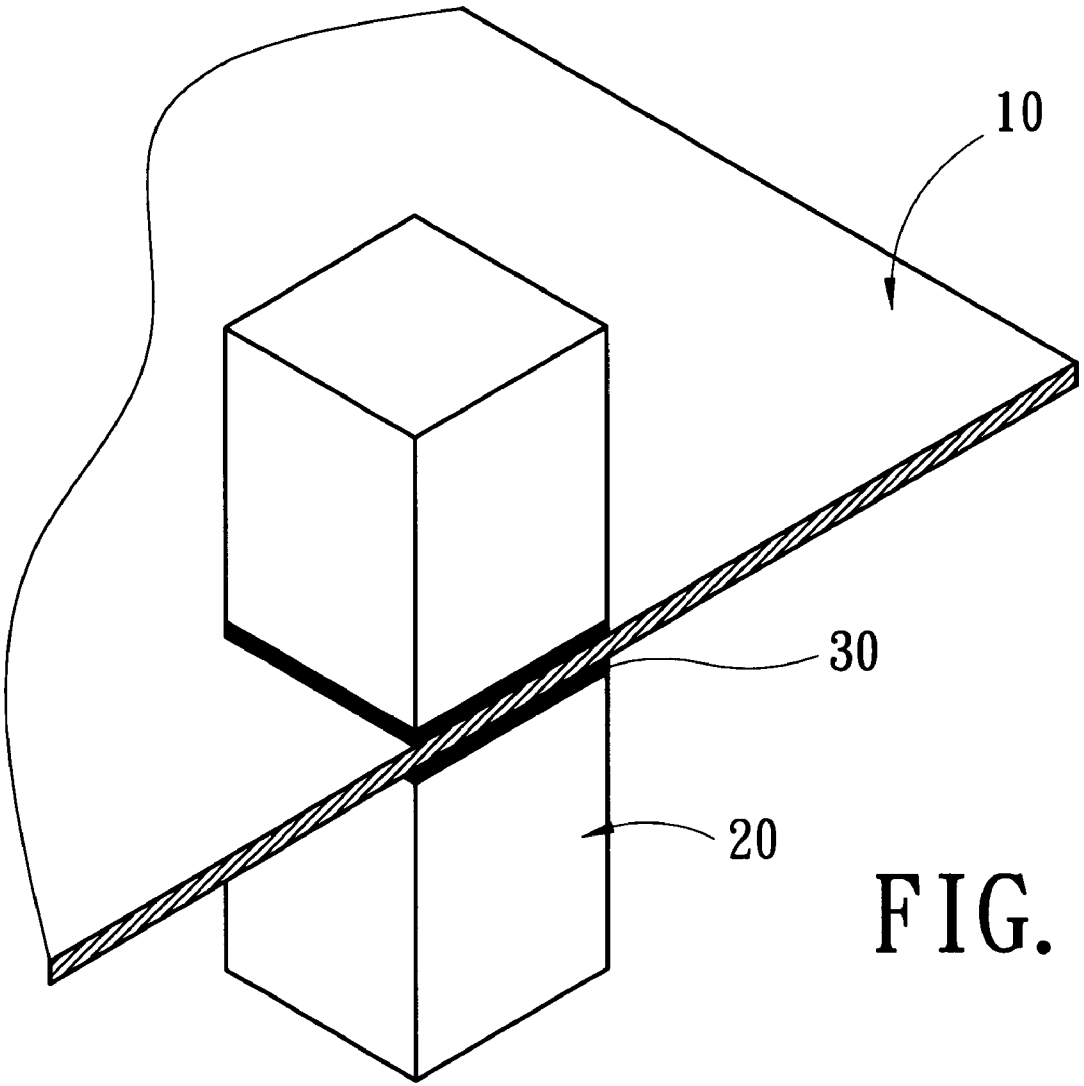
FIG. 1 is a fragmented schematic view of a conventional corrugated paper and EPE structure.
Figure 2:
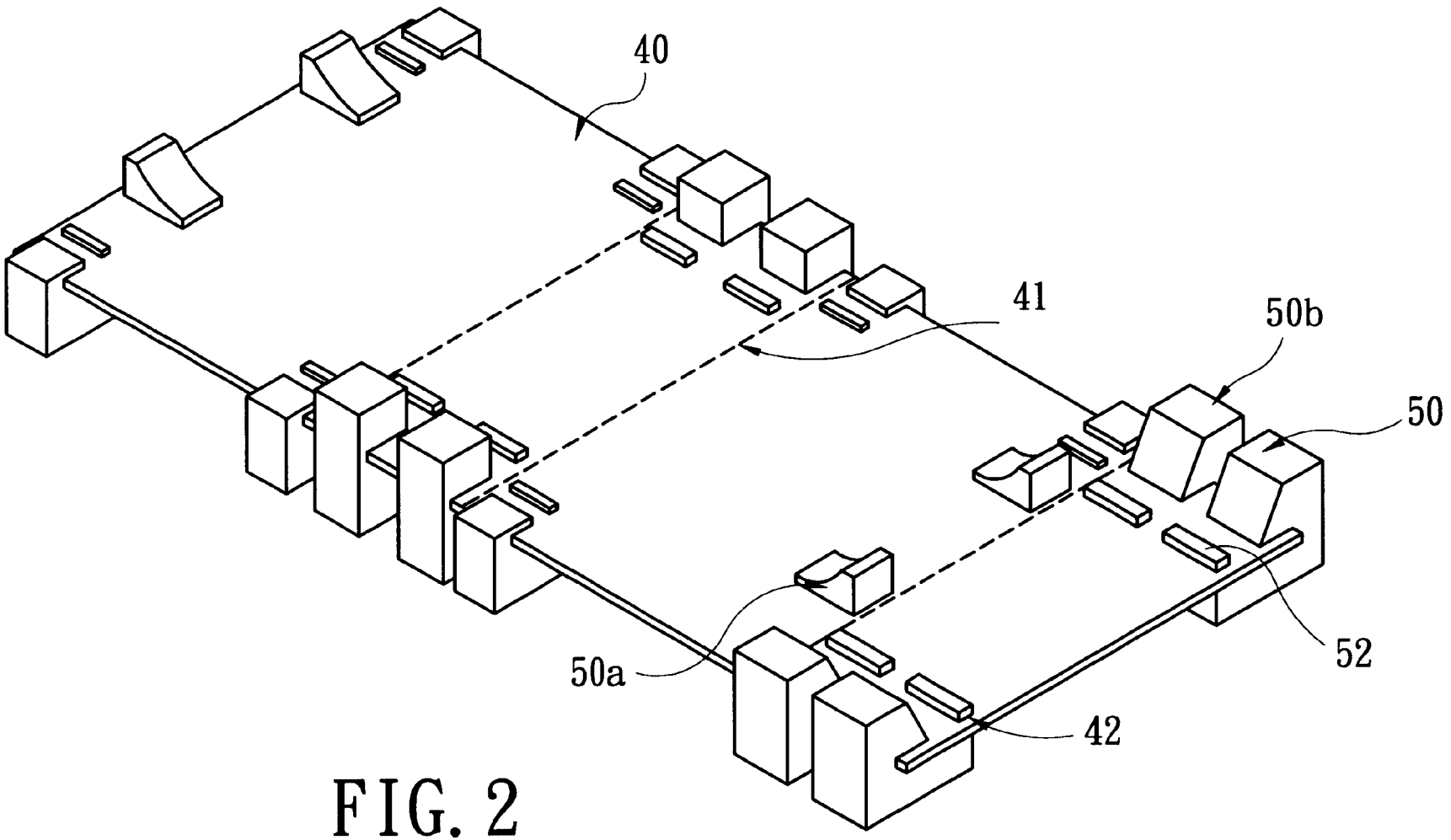
FIG. 2 is a schematic view of a structure of the corrugated paper and cushion pads of the invention.

Referring to FIG. 2, the cushion package structure of the invention consists of: a corrugated paper 40 and a plurality of cushion pads 50.

Figure 3:
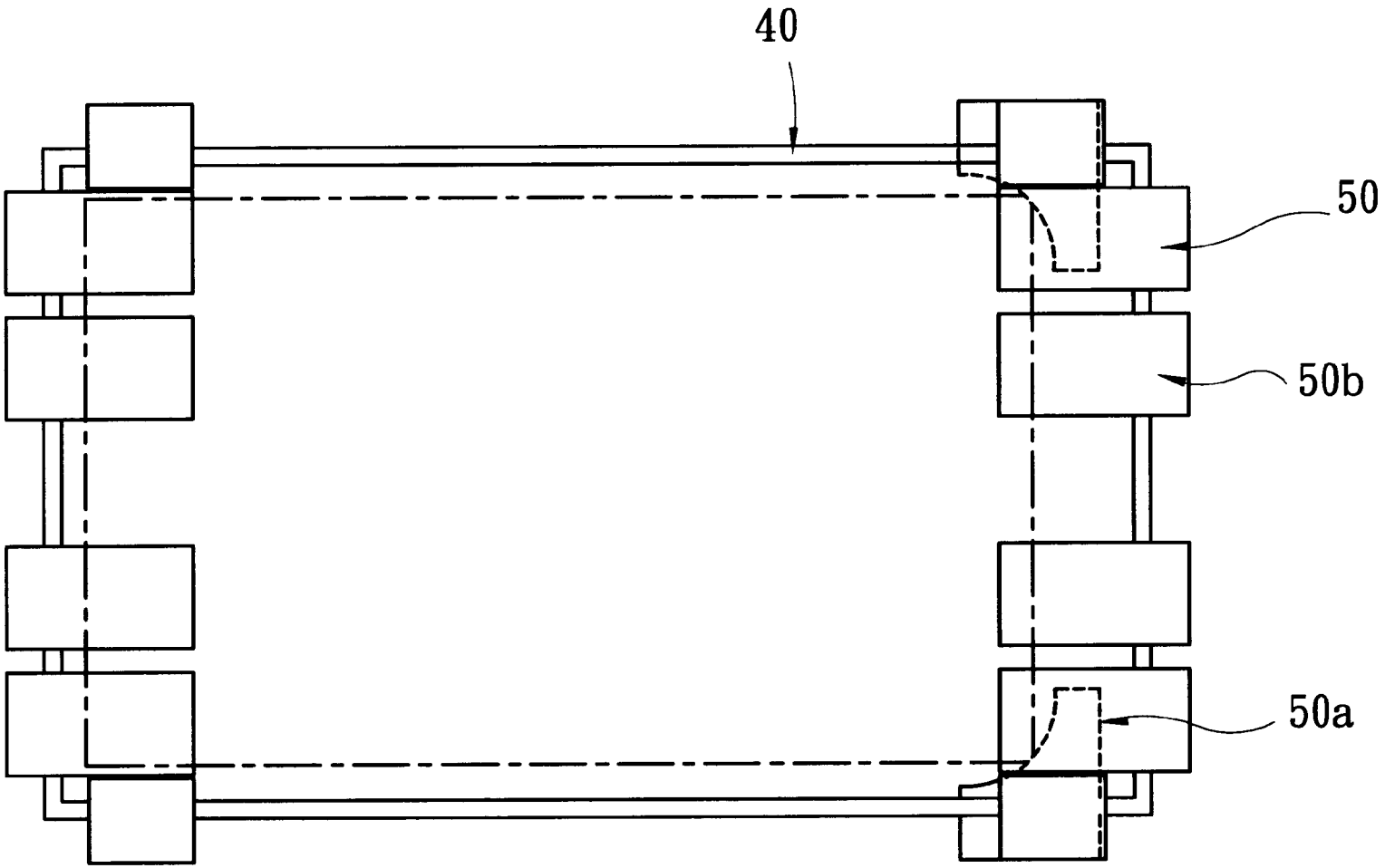
FIG. 3 is a schematic view of a structure of the corrugated paper and cushion pads of the invention, for holding an article.
Figure 4:
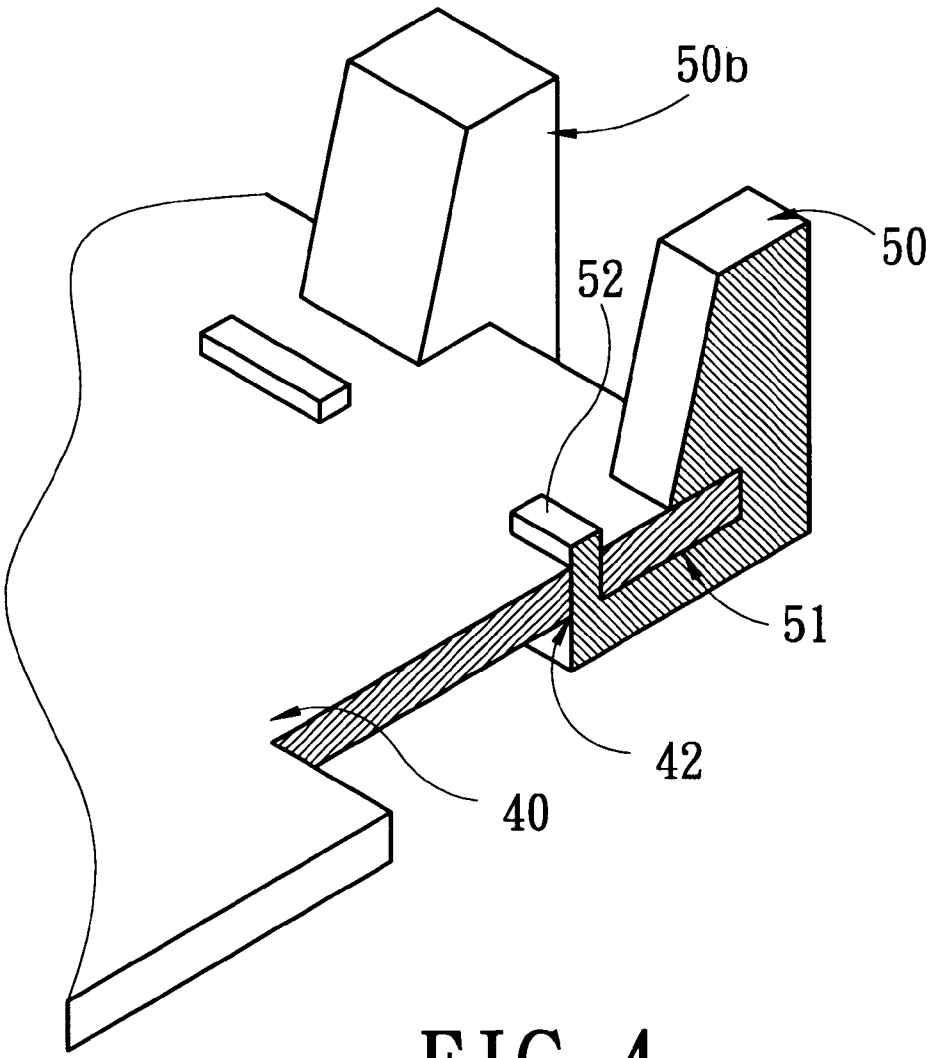
FIG. 4 is a fragmented schematic view of a structure of the corrugated paper and cushion pads of the invention.

The corrugated paper. 40 for serving as the outermost layer of the package structure. The surface of the corrugated paper 40 has a plurality of preset bend lines 41 and apertures 42. Through the bend lines 41, the corrugated paper 40 may be bent or folded to wrap around the exterior of goods to be packaged for holding the goods in the corrugated paper 40 (as shown in FIG. 3); and The plurality of cushion pads 50 made from EPE (such as elastic blowing materials). Each cushion pad 50 has at least one slit 51 and a hook section 52 located on a lower rim of the slit 51 and extending outwards. The slit 51 can clip an edge rim of the corrugate paper 40, and the hook section 52 can be inserted into an aperture 42. Thereby the cushion pad 50 may be anchored on the corrugated paper 40 (as shown in FIG. 4).

Figure 5:
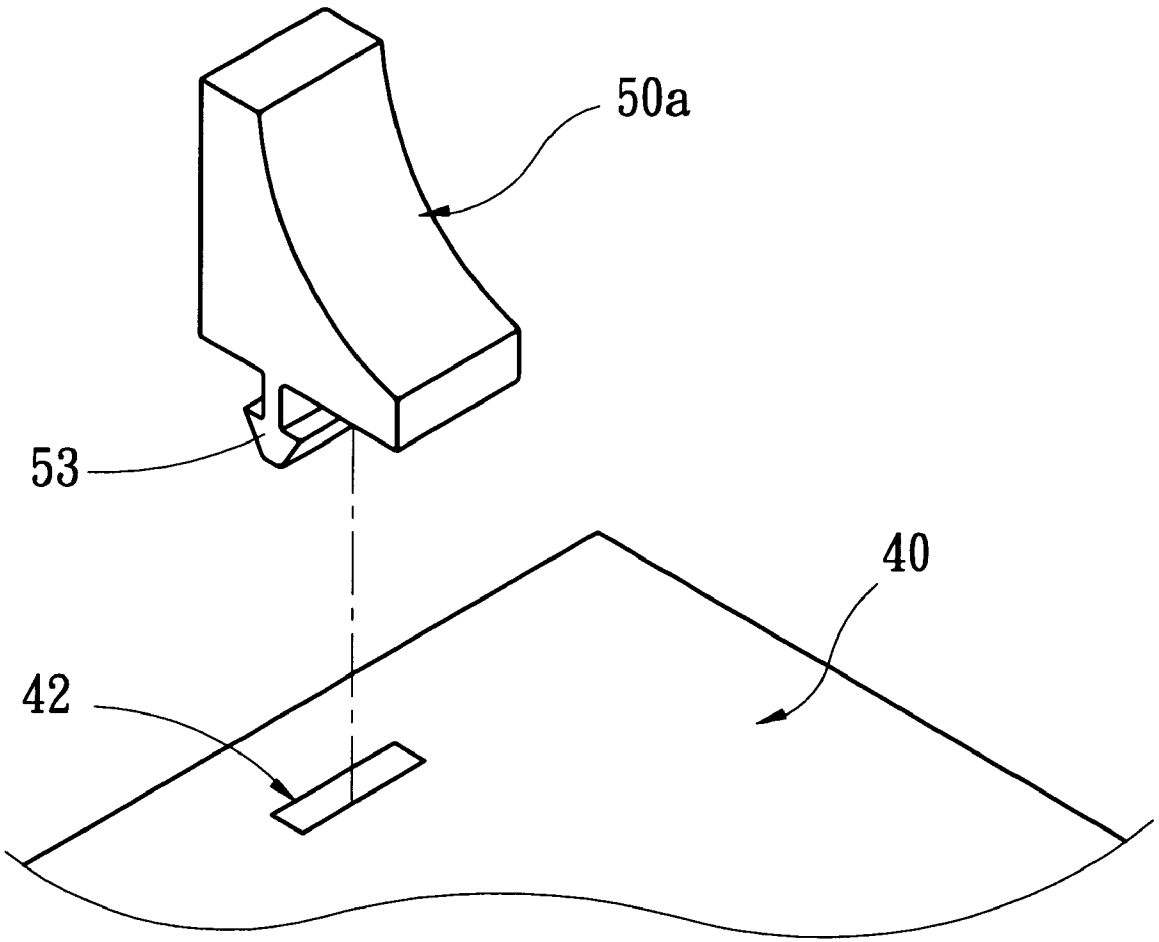
FIG. 5 is a schematic view of another embodiment of the invention.

In a preferred embodiment, depending on the shape of the goods to be packaged, second cushion pads 50*a* may be provided and deployed on desired locations of the corrugated paper 40 (such as adjacent to the bend lines 41) to clamp and hold the goods more securely inside. The second cushion pads 50*a* are made from same EPE materials as the cushion pads 50. Because the EPE has elastic and forming properties, the second cushion pad 50*a* may be formed with an insert pin 53, which has an inverse hook (shown in FIG. 5). Hence the second cushion pads 50*a* may be inserted into the apertures 42 formed on the corrugated paper 40 for anchoring. Also, third cushion pads 50*b* may be provided and anchored on the corrugated paper 40 for holding the corrugated paper 40 upright on the floor to support the corrugated paper 40 and the packaged goods (as shown in FIG. 3).

By means of the latching and coupling designs for the corrugated paper and EPE, the invention can achieve the objective of meeting environmental protection recycling regulations. Furthermore, the invention provides the following advantages:

1. In terms of structure, the invention eliminates hot adhesive used in the conventional techniques. The structure is greatly simplified and thus can reduce costs.
2. Because hot adhesive is no longer used, EPE may be reclaimed and recycled to achieve environmental protection recycling benefits.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A cushion package structure, comprising:

a corrugated paper serving as an outermost layer of the package structure and having a surface formed with a plurality of bend lines and apertures; and a plurality of cushion pads each having a slit and a hook section located along a lower rim of the slit, the slit clipping an edge rim of the corrugated paper, the hook section being inserted into one of the apertures for anchoring the cushion pads on the corrugated paper.

2. The cushion package structure of claim 1, wherein the cushion materials are blowing materials having elasticity.

3. The cushion package structure of claim 1 further comprising a plurality of second cushion pads each having an insert pin which has an inverse hook for inserting into one of the apertures to anchor the second cushion pad on the corrugated paper.

4. The cushion package structure of claim 3, wherein the plurality of second cushion pads are located on locations adjacent to the plurality of bend lines, the plurality of bend lines allowing the corrugated paper bending or folding to wrap the exterior of goods for packaging the goods in the corrugated paper and using the plurality of second cushion pads to clamp the packaged goods securely.

5. The cushion package structure of claim 1 further comprising a plurality of third cushion pads standing upright on a floor to support the corrugated paper and goods being packaged.

* * * * *